US008453624B2

(12) United States Patent
Selano

(10) Patent No.: US 8,453,624 B2
(45) Date of Patent: Jun. 4, 2013

(54) METHOD AND APPARATUS FOR ENHANCING FUELS

(76) Inventor: Jeff Selano, Dallas, GA (US)

( * ) Notice: Subject to any disclaimer, the term of this patent is extended or adjusted under 35 U.S.C. 154(b) by 73 days.

(21) Appl. No.: 13/095,946

(22) Filed: Apr. 28, 2011

(65) Prior Publication Data

US 2012/0272934 A1 Nov. 1, 2012

(51) Int. Cl.
*F02M 27/00* (2006.01)

(52) U.S. Cl.
USPC ..... 123/538; 123/536

(58) Field of Classification Search
USPC ..... 123/536–538
See application file for complete search history.

(56) References Cited

U.S. PATENT DOCUMENTS 3,597,668 A * 8/1971 Yoshimine ..... 361/225
5,013,450 A * 5/1991 Gomez ..... 210/687
5,069,190 A * 12/1991 Richards ..... 123/538
5,524,594 A * 6/1996 D'Alessandro ..... 123/538
5,881,702 A * 3/1999 Arkfeld ..... 123/538
6,550,460 B2 * 4/2003 Ratner et al. ..... 123/538
7,942,135 B1 * 5/2011 Daywalt ..... 123/538
2005/0145225 A1 * 7/2005 Ratner et al. ..... 123/538
2006/0243256 A1 * 11/2006 Hornig ..... 123/536

* cited by examiner

*Primary Examiner* — Noah Kamen
*Assistant Examiner* — Hung Q Nguyen
(74) *Attorney, Agent, or Firm* — Schmid PA

(57) ABSTRACT

Disclosed is an environmentally responsible apparatus and method for increasing fuel economy and increasing engine performance. The apparatus further provides a method for reducing engine emissions and reducing greenhouse gasses. The apparatus attaches to an engine's fuel line and passing the fuel through a compacted copper wire mesh housed within. The compacted wire mesh is thought to increase the fuel's vapor pressure which reduces fuel consumption and increases engine performance.

18 Claims, 3 Drawing Sheets

METHOD AND APPARATUS FOR ENHANCING FUELS

FIELD OF THE INVENTION

The present invention relates generally to the field of internal combustion engines. More particularly, this invention relates to methods and compositions for increasing fuel efficiency and modifying emissions characteristics of internal combustion engines.

BACKGROUND

The natural inefficiency inherent in fuel combustion systems, such as internal combustion engines, is well documented. Specifically, internal combustion engines utilizing fossil fuels and other combustion systems using a variety of different types of fuels and fuel mixtures typically emit unburned or under-burned fuel from the exhaust as well as the undesirable by-products of combustion. This under-burning of fuel causes severe environmental problems as the resultant pollutants, some of which are thought to be cancer causing, are emitted directly into the atmosphere.

In addition to being emitted directly into the atmosphere through the exhaust, many by-products of fuel combustion simply accumulate on internal engine components, with often 30% of the exhaust being directed into the engine. This causes those engine components to wear out sooner and require frequent maintenance and repairs which can lead to shortened total engine life. Furthermore, the incomplete combustion of fuel within an engine substantially under-utilizes the energy capacity of the fuel. Specifically, in addition to the environmental concerns due to pollution attributed to the under-utilization of the energy capacity of fuel, there are also resultant losses in economic efficiency due to higher fuel and maintenance expenses as well as a generally shorter engine life.

Others in the art have developed various fuel conditioning assemblies in an attempt to alleviate some of the above-mentioned problems. For example, in the past various types of heating devices were incorporated into a fuel conditioning assembly so as to raise the temperature of the fuel and thereby improve the combustion properties of the fuel. Specifically, such devices include a heating element which comes into contact with the fuel so as to raise it's temperature and consequently reduce the density of the fuel. Of course, such a procedure can also raise the engine temperature and can prove quite hazardous.

Additionally, others in the art have attempted to add various types of additives to the fuel in an attempt to positively effectuate improvement in the fuel's combustion properties. Such additives have included the addition of minute quantities of Cupric salts, for example, to the fuel supply. Unfortunately, however, it can be difficult to obtain and consistently add those additives in an efficient manner. Also, if the additives are not completely soluble in the fuel, they may be quite harmful to the engine. Accordingly, none of these devices have actually been successfully and practically incorporated with a combustion engine in a simple, economical, and maintenance free manner.

In addition to the above-referenced approaches, others in the art have sought to introduce various metals, in combination, within a flow of fuel in an attempt to generate a chemical reaction effecting the combustion properties of the fuel. Although some of these devices do improve the combustion properties of the fuel somewhat, those skilled in the art have not been successful in substantially increasing the combustion properties in a practical and effective manner. In particular, such devices have been unable to effectuate a substantial improvement such as would be necessary to offset the price of purchase and installation of the device into existing engines.

Indeed, the improved combustion properties provided by existing fuel conditioning assemblies are so slight that a user may find it more economical to increase the combustion properties of the fuel simply by switching to a higher octane rated fuel or by mixing the fuel with an additive.

Thus, what is needed is an apparatus and method for increasing both fuel economy and engine performance along with reduced emissions.

SUMMARY

The present invention provides an environmentally responsible apparatus and method for increasing fuel economy and increasing engine performance. The apparatus further provides a method for reducing engine emissions and reducing greenhouse gasses. The apparatus attaches to an engine's fuel line and enhances the fuel by passing the fuel through a compacted wire mesh residing within the housing. The compacted wire mesh is thought to increase the vapor pressure of the fuel as the fluid passes through the apparatus.

In greater detail, the method of operating an internal combustion engine includes the steps of placing a housing in series relationship respective to fuel flow to the engine so that the fuel flows through the housing. A compacted copper wire mesh is then encapsulated within the housing. Typically the housing is made cylindrical. The cylindrical housing is fitted with end plugs respectively defining the inlet and outlet ports. The end plugs can each include a nipple for direct connection to a flexible portion of a fuel line.

The wire mesh can be compacted to a density relative to the housing within the housing to a density between 0.5 g/cc to 7 g/cc. In a further embodiment the wire mesh is compacted to a density between 1 g/cc to 6 g/cc. An alternative embodiment includes the wire mesh compacted to a density between 1.5 g/cc to 5 g/cc.

The copper wire mesh may be either substantially pure copper or a copper alloy. The engine may be most any type of combustion engine including both diesel and gasoline engines. The fuel can be almost any hydrocarbon based fuel such as, but not limited to, gasoline (both leaded and unleaded), diesel fuel, methanol, alcohol, and LPG.

A further embodiment includes a fuel treatment apparatus for connection in a series relationship within a fuel line of an internal combustion engine. The apparatus includes a housing with an inlet end and an outlet end. A compacted wire mesh resides within the housing which is typically cylindrical. The cylindrical housing is fitted with end plugs respectively defining the inlet and outlet ports.

The copper wire mesh housed within the apparatus can be of varying degrees of density relative to the volume of the chamber housing. Typically, the density of the compacted wire mesh has a density of between 0.5 g/cc to 7 g/cc. A further embodiment includes the compacted wire mesh with a density between 1 g/cc to 6 g/cc and a density between 15 g/cc to 50 g/cc.

DRAWINGS

DETAILED DESCRIPTION

Figure 1:
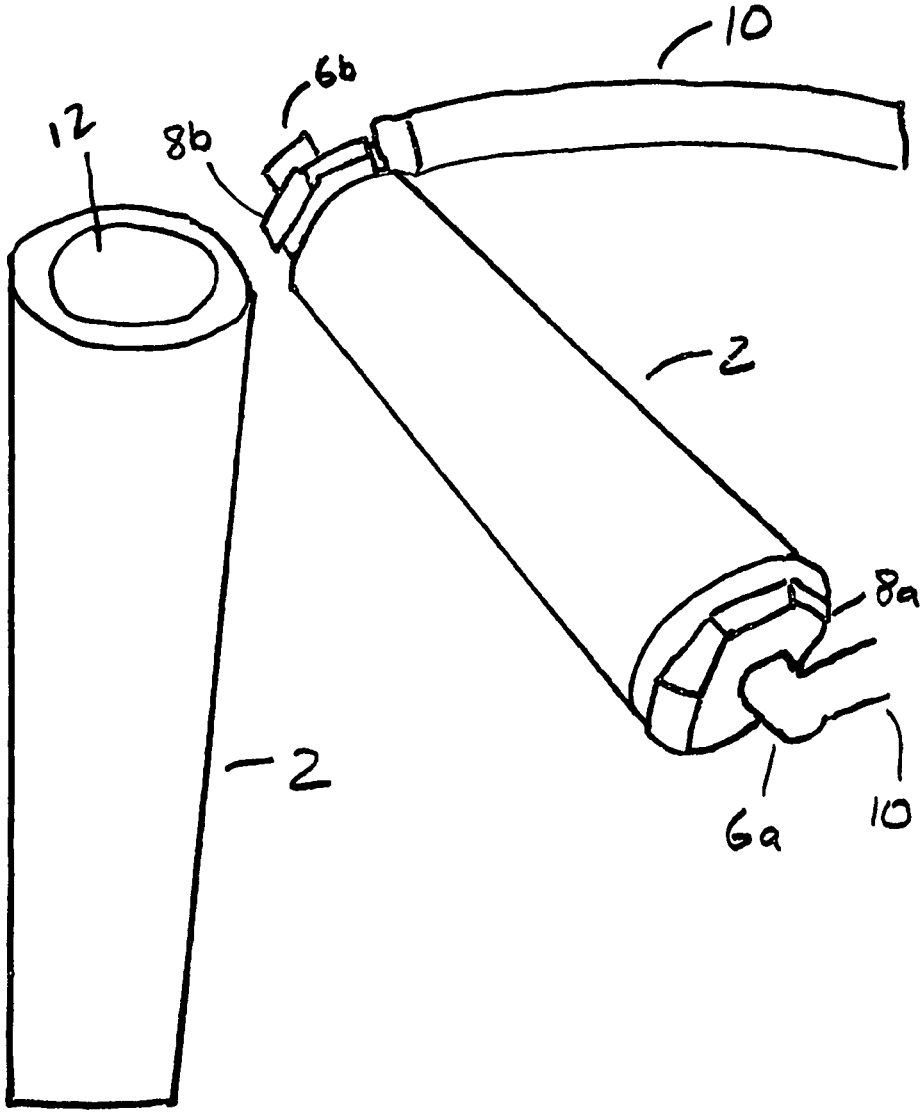
FIG. 1 illustrates an embodiment of the present apparatus showing the apparatus for enhancing fuels with the housing, inlet and outlet ports, end plugs and fuel line connected to the apparatus.

Disclosed is an environmentally responsible apparatus and method for increasing fuel economy and increasing engine performance. The apparatus further provides a method for reducing engine emissions and reducing greenhouse gasses. The apparatus attaches to an engine's fuel line and enhances the fuel by passing the fuel through a compacted wire mesh residing within the housing. The compacted wire mesh is thought to increase the vapor pressure of the fuel as the fluid passes through the apparatus.

As used herein, the term "internal combustion engine" is used in its broad sense to include engines which operate based upon the internal combustion of a fuel. There are numerous engines based upon this principal, and these will readily be recognized by those of ordinary skill in the area.

Also, the term "fuel economy" is used herein in it usual sense, and relates to the efficiency of an internal combustion engine as regards consumption of fuel, i.e. increased fuel efficiency is obtained when the amount of engine output per unit fuel consumed is increased, and vice versa.

The term "wire mesh" includes a mesh with wires surrounding open spaces. Wire meshes are typically defined by wire gauge and a mesh weave defined by the number of openings per square inch. The term "copper" is inclusive of pure copper and copper alloys wherein the copper component comprises at least 50% of the alloy. By way of example and not limitation, is an example of a copper mesh for use with the present apparatus is one available from Allen Special Product of Hatfield, Pa. having a mesh weave of about 15 and doubled over in a continuous loop or sock like fashion. (Manufacturer Part No: 03090/03095).

The wire mesh is compacted or compressed into the housing or cylinder tube of the apparatus. The term "compacted" is inclusive of such terms as "compressed" or "pressed". A "compacted wire mesh" describes the state of being of the mesh in same way as "welded," "intermixed," "ground in place," and "press fitted" and is a structural limitation. The wire mesh may be pre-compacted before being inserted into the housing of the apparatus.

The wire mesh is compacted to a density relative to the volume of the housing. For example a pipe having an inner diameter of 0.5 inches by five (5) inches long has a volume of about 16 cc. In the example Allen Special Product wire mesh, the mesh has a weight of about 0.4 ounces per foot or about 11.3 grams per foot. Thus three (3) feet of wire mesh weighs about 34 grams and when compacted into the five (5) inch long pipe the density of wire mesh relative to the inner volume of the pipe is 2.1 g/cc. If six feet of wire mesh weighing 68 grams is compacted into the same pipe the density of wire mesh relative to the inner volume of the pipe is 4.2 g/cc. In a further example, a pipe having an inner diameter of 1.25 inches by four (4) inches long has a volume of about 80 cc. If twelve (12) feet of wire mesh weighing 136 grams is compacted into the same pipe the density of wire mesh relative to the inner volume of the pipe is 1.7 g/cc.

Example densities of the wire mesh relative to the volume within the housing in the various embodiments include between 0.5 g/cc to 7 g/cc and in a further embodiment between 1 g/cc to 6 g/cc. Additional embodiments include densities of the wire mesh relative to the volume within the housing in the various embodiments include between 1.5 g/cc to 5 g/cc and between 1 g/cc to 4.5 g/cc.

Figure 2:
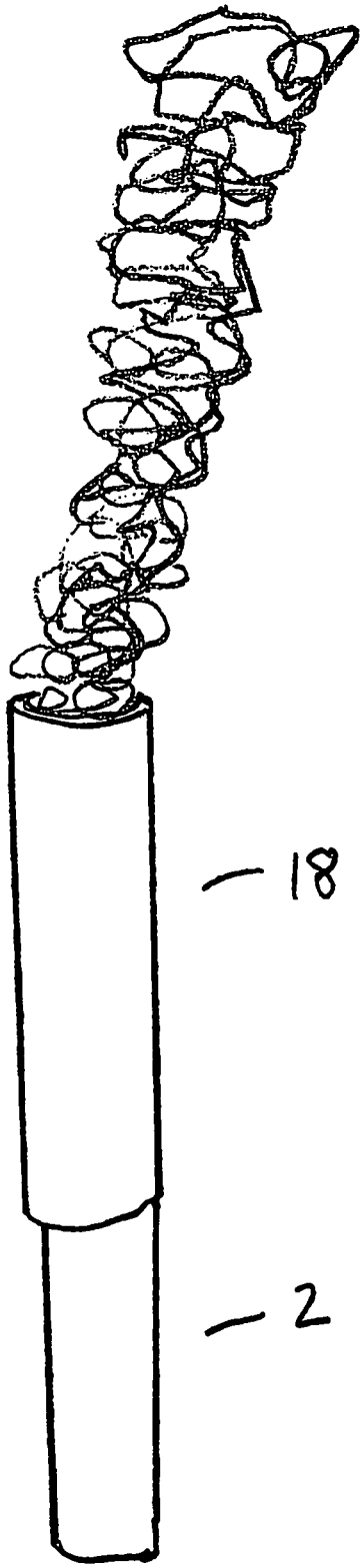
FIG. 2 depicts a further embodiment of the method for enhancing fuels showing the compaction of the wire mesh into the housing.
Figure 3:
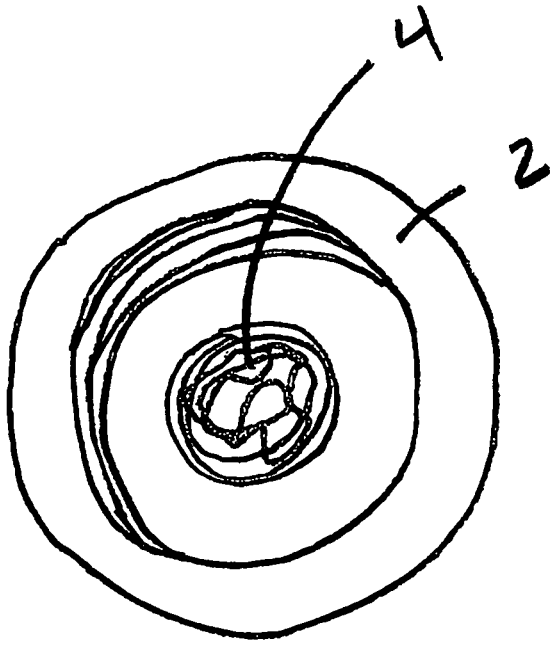
FIG. 3 illustrates a top view of the housing with the compacted wire mesh inserted within the housing of the apparatus.

Referring now in greater detail to the drawings in which like numerals indicate like parts throughout the several views, FIGS. 1-3 depict the present apparatus and method in various embodiments of the present invention.

FIG. 1 illustrates an embodiment of the present apparatus showing the apparatus for enhancing fuels having a housing 2, inlet and outlet ports 6*a-b*, end plugs 8*a-b* and fuel line 10 connected to the apparatus. The end plugs 8*a-b* may, in the illustrated embodiment be secured to the housing 2 threadely fitted together as shown by threads 12. End plugs 8*a-b* and corresponding inlet and outlet ports 6*a-b* may also be fitted using other means such as welding or forming the end plugs 8*a-b* and corresponding inlet and outlet ports 6*a-b* with the housing.

FIG. 2 depicts a further embodiment of the method for enhancing fuels showing the compaction of the wire mesh 4 into the housing 2. The mesh 4 may be compacted before insertion, during or after insertion into the housing 2. Various tools may be used to insert the mesh 4, shown here in FIG. 2 is a guide tube 18. Additionally, FIG. 3 illustrates a top view of the housing 2 with the compacted wire mesh 4 inserted within the housing of the apparatus.

It should be understood that the foregoing description is only illustrative of the present invention. Various alternatives and modifications can be devised by those skilled in the art without departing from the spirit of the present invention. Accordingly, the present invention is intended to embrace all such alternatives, modifications and variances that fall within the scope of the claims.

The invention claimed is:

1. A method of operating an internal combustion engine comprising the steps of:

placing a housing in series relationship respective to fuel flow to said engine so that the fuel flows through the housing;

encapsulating a copper wire alloy mesh within the housing wherein the wire is a mesh weave defined by the number of openings per square inch; and compacting the copper wire mesh and wherein the compacted wire mesh has a density relative to the volume within the housing of between 0.5 g/cc to 7 g/cc.

2. The method of claim 1 and further including the step of making said housing cylindrical.

3. The method of claim 1, wherein the compacted wire mesh has a density relative to the volume within the housing of between 1 g/cc to 6 g/cc.

4. The method of claim 1, wherein the compacted wire mesh has a density relative to the volume within the housing of between 1.5 g/cc to 5 g/cc.

5. The method of claim 1, wherein the compacted wire mesh has a density relative to the volume within the housing of between 1.5 g/cc to 4.5 g/cc.

6. The method of claim 1, wherein the housing comprises a cylindrical member fitted with end plugs respectively defining said inlet and outlet ports.

7. The method of claim 6, wherein said end plugs each further comprise a nipple for direct connection to a flexible portion of a fuel line.

8. The method of claim 1, wherein the copper wire comprises a copper alloy.

9. The method of claim 1 wherein the engine is a diesel engine.

10. The method of claim 1 wherein the engine is a gasoline engine.

11. A fuel treatment apparatus for connection in series relationship within a fuel line of an internal combustion engine comprising:

a housing having a inlet end and an outlet end; and a compacted copper wire alloy mesh residing within the housing wherein the wire is a mesh weave defined by the number of openings per square inch and wherein the compacted wire mesh has a density relative to the volume within the housing of between 0.5 g/cc to 7 g/cc.

12. The apparatus of claim 11, wherein the housing is cylindrical.

13. The apparatus of claim 12, wherein the cylindrical housing is fitted with end plugs respectively defining said inlet and outlet ports.

14. The apparatus of claim 13, wherein said end plugs each further comprise a nipple for direct connection to a flexible portion of a fuel line.

15. The apparatus of claim 11, wherein the compacted wire mesh has a density relative to the volume within the housing of between 1.0 g/cc to 6 g/cc.

16. The apparatus of claim 11, wherein the compacted wire mesh has a density relative to the volume within the housing of between 1.5 g/cc to 5 g/cc.

17. The apparatus of claim 11, wherein the engine is either a gasoline engine or diesel engine.

18. A fuel treatment apparatus for connection in series relationship within a fuel line of an internal combustion engine comprising:

a housing having an inlet end and an outlet end; and a compacted copper wire alloy mesh residing within the housing wherein the compacted wire mesh has a density relative to the volume within the housing of between about 0.5 g/cc to 6 g/cc and wherein the copper alloy mesh is a wire mesh weave defined by the number of openings per square inch.

* * * * *